US008170709B2

(12) United States Patent
Puissant

(10) Patent No.: US 8,170,709 B2
(45) Date of Patent: May 1, 2012

(54) METHOD FOR INTRODUCING A WEFT THREAD IN A WEAVING MACHINE

(75) Inventor: Patrick Puissant, Merelbeke (BE)

(73) Assignee: Picanol, N.V., Ieper (BE)

( * ) Notice: Subject to any disclaimer, the term of this patent is extended or adjusted under 35 U.S.C. 154(b) by 1010 days.

(21) Appl. No.: 11/919,132

(22) PCT Filed: Apr. 5, 2006

(86) PCT No.: PCT/EP2006/003063
§ 371 (c)(1),
(2), (4) Date: Apr. 30, 2008

(87) PCT Pub. No.: WO2006/114187
PCT Pub. Date: Nov. 2, 2006

(65) Prior Publication Data

US 2009/0084461 A1 Apr. 2, 2009

(30) Foreign Application Priority Data

Apr. 25, 2005 (BE) ..... 2005/0211

(51) Int. Cl.
*G06F 19/00* (2011.01)

(52) U.S. Cl. ..... 700/140; 139/435.2

(58) Field of Classification Search .... 139/435.1–435.6; 700/140, 141
See application file for complete search history.

(56) References Cited

U.S. PATENT DOCUMENTS

| | | | | | |
|---|---|---|---|---|---|
| 4,446,893 | A | * | 5/1984 | Gunneman et al. | 139/11 |
| 4,590,972 | A | * | 5/1986 | Sugita et al. | 139/435.2 |
| 4,625,770 | A | * | 12/1986 | Ishikawa | 139/336 |
| 4,658,865 | A | * | 4/1987 | Gotoh | 139/435.2 |
| 4,673,004 | A | * | 6/1987 | Rosseel et al. | 139/435.2 |
| 4,702,285 | A | * | 10/1987 | Sugita | 139/452 |
| 4,716,943 | A | | 1/1988 | Yoshida et al. | |
| 4,722,370 | A | * | 2/1988 | Manders | 139/429 |
| 4,744,393 | A | * | 5/1988 | Takegawa | 139/116.2 |
| 4,758,968 | A | * | 7/1988 | Lord | 702/81 |
| 4,781,224 | A | * | 11/1988 | Gotoh et al. | 139/435.2 |
| 4,827,990 | A | * | 5/1989 | Takegawa | 139/435.2 |
| 4,877,064 | A | * | 10/1989 | Pezzoli | 139/435.1 |
| 4,901,770 | A | * | 2/1990 | Takegawa | 139/435.2 |
| 4,924,406 | A | * | 5/1990 | Bergamini et al. | 700/143 |
| 5,086,812 | A | | 2/1992 | Van Bogaert et al. | |
| 5,095,953 | A | * | 3/1992 | Makino | 139/435.2 |
| 5,107,902 | A | * | 4/1992 | Wahhoud | 139/435.1 |
| 5,115,840 | A | * | 5/1992 | Yamada | 139/435.2 |
| 5,119,308 | A | * | 6/1992 | Samoto | 700/139 |
| 5,134,568 | A | * | 7/1992 | Sainen | 700/140 |

(Continued)

FOREIGN PATENT DOCUMENTS

EP 0 493 328 A1 7/1992

*Primary Examiner* — Danny Worrell
(74) *Attorney, Agent, or Firm* — Bacon & Thomas, PLLC

(57) ABSTRACT

Method for introducing a weft thread in a weaving machine which comprises a device (10) for introducing a weft thread (3, 64), which method comprises adjusting a control parameter and adapting the number of insertions for determining the mean deviation of an insertion parameter. Weaving machine which comprises a device (10) for employing an abovementioned method.

9 Claims, 3 Drawing Sheets

U.S. PATENT DOCUMENTS 5,293,907 A * 3/1994 Tamura ..... 139/1 E
5,320,142 A 6/1994 Sainen
5,322,089 A * 6/1994 Yamada ..... 139/435.2
5,375,435 A * 12/1994 Gille et al. ..... 66/211
5,440,495 A * 8/1995 Sainen et al. ..... 700/140
5,748,481 A * 5/1998 Nakade ..... 700/143
6,062,273 A 5/2000 Peeters et al.
6,142,190 A * 11/2000 Nakada et al. ..... 139/435.5
6,305,433 B1 10/2001 Peeters
6,314,335 B1 * 11/2001 Sainen et al. ..... 700/140
6,525,496 B1 2/2003 Bilcke
6,748,981 B2 * 6/2004 Gielen et al. ..... 139/435.2
7,055,554 B2 * 6/2006 Fujitani ..... 139/435.2
7,063,109 B2 * 6/2006 Siegl et al. ..... 139/435.2
7,110,847 B2 * 9/2006 Ostyn ..... 700/140
7,762,288 B2 * 7/2010 Puissant ..... 139/435.2
2002/0026961 A1 3/2002 Banba et al.
2002/0026962 A1 * 3/2002 Banba et al. ..... 139/435.1
2008/0216912 A1 * 9/2008 Puissant et al. ..... 139/435.2
2009/0084461 A1 * 4/2009 Puissant ..... 139/452
2009/0120524 A1 * 5/2009 Puissant ..... 139/194
2009/0165885 A1 * 7/2009 Puissant ..... 139/434

* cited by examiner

METHOD FOR INTRODUCING A WEFT THREAD IN A WEAVING MACHINE

BACKGROUND OF THE INVENTION

1. Field of the Invention

The invention relates to a method for introducing a weft thread in a weaving machine. The invention also relates to a weaving machine for employing a method of this type.

2. Related Art

Weaving machines, more particularly air weaving machines, in which compressed air is fed to a blower, are known. In these machines, one or more main blowers and a number of auxiliary blowers are provided for the purpose of introducing a weft thread into a shed. Weaving machines of this type include a feed device for supplying compressed air to a blower, as known for example from EP 0 442 546 B1, EP 0 879 307 B1 or EP 1 086 265 B1. In the case of weaving machines in which various types of weft threads are introduced into a shed in a pattern, an associated set of main blowers with an associated feed device for compressed air is provided for each of these weft threads. During the introduction of a weft thread, compressed air is fed at a high pressure to the associated main blowers and auxiliary blowers. For the remaining time, compressed air at a lower pressure is fed to these main blowers in order to prevent a weft thread from dropping out of these main blowers. The high pressure is, for example, between 2 and 7 bar, while the lower pressure is, for example, between 0.02 and 1 bar.

Compressed air at a high pressure is supplied, for example by controlling a shut-off valve which is disposed between a buffer vessel containing compressed air at a high pressure and a set of main blowers. The quantity of compressed air supplied at a high pressure can in this case be adjusted with the aid of a motor-controlled throttle valve which is disposed between the buffer vessel and an abovementioned shut-off valve. According to an alternative, this throttle valve can be disposed between an abovementioned shut-off valve and a set of main blowers. A motor-controlled throttle valve of this type comprises, for example, a controllable stepper motor which can be rotated in both directions with a desired number of steps by means of a control unit.

It is known to adjust the quantity of compressed air supplied at a high pressure during weaving as a function of a deviation of a measured insertion parameter. In this context, this quantity can, for example, be adjusted in such a manner that a weft thread which has been introduced reaches the end of the shed at an approximately desired angle position of the weaving machine. According to one option, the deviation, more specifically the difference in time and/or in angle between the instant at which the weft thread reaches the end of the shed and the instant at which the main drive shaft of the weaving machine reaches a defined angle position, is determined. Then, for example, the throttle valve is adjusted in such a manner that the said deviation, more particularly this difference in time and/or angle, vanishes.

Since each weft thread behaves differently during the introduction into a shed, also referred to as the insertion, it is customary to determine a mean deviation for a number of successive insertions of a weft thread of this nature. By way of example, it is possible to determine a mean for the deviations on the basis of a measured insertion parameter, which deviations were determined, for example, for 32 successive insertions. The throttle valve can then be adjusted taking account of this mean deviation which has been determined. It is also known to input a threshold value for the mean deviation, more particularly a mean value which must be exceeded before adjustment of the throttle valve needs to be carried out. If the mean deviation exceeds the said threshold value, the throttle valve is suitably adjusted, for example taking account of this deviation. The abovementioned method has the drawback that the throttle valve sometimes has to be adjusted frequently and unnecessarily or that the throttle valve is not adjusted, is adjusted insufficiently or is adjusted too late. Moreover, the threshold value may be too low for one type of yarn, so that the system will react too quickly, while the said threshold value may be too high for a different type of yarn, causing the system to react too slowly.

SUMMARY OF THE DISCLOSURE

It is an object of the invention to provide a method and a device which do not have the abovementioned drawbacks.

For this purpose, a method according to the invention comprises adjusting a control parameter as a function of a mean deviation of an insertion parameter and adapting the number of insertions for determining a mean deviation of an insertion parameter.

This method according to the invention offers the advantage that in the event of a significant deviation of an insertion parameter, the control parameter can be changed or adapted relatively quickly, without a control parameter having to be changed or adapted unnecessarily. The result is what can be described as a stable system. A method of this type according to the invention is particularly suitable for introducing irregular weft threads into a shed in fast-moving weaving machines. Moreover, a method of this type also offers numerous advantages which will be described in more detail below. The method also permits better adjustment of the quantity of compressed air supplied at a high pressure.

According to a preferred embodiment, a control parameter is changed as a function of a mean deviation of an insertion parameter, and the number of insertions for determining the mean deviation of an insertion parameter is adapted as a function of the number of insertions between at least two changes to a control parameter. This permits the abovementioned number of insertions to be changed or adapted in an advantageous way.

According to a preferred embodiment, a method also comprises adapting a threshold value for the mean deviation. Preferably, a threshold value is adapted as a function of the number of insertions for determining the mean deviation of an insertion parameter. According to a particular embodiment, a threshold value is increased if the number of insertions is increased, and a threshold value is reduced if the number of insertions is reduced. This allows the regulation of a control parameter to be improved still further.

According to a preferred embodiment, a method comprises the initial setting of the number of insertions. This offers the advantage that with a new type of weft thread, a starting value for the number of insertions can be set immediately. If it is established after a certain time that the desired result is not achieved with the automatically adapted number of insertions, the initial value or starting value can be reset, and more particularly the initial value or starting value can be reset manually.

The invention also relates to a weaving machine which makes use of a method as described above.

DESCRIPTION OF THE DRAWINGS

Further features and advantages of the invention will emerge from the following description of the exemplary embodiments depicted in the drawings and from the dependent claims. In the drawings:

DETAILED DESCRIPTION

Figure 1:
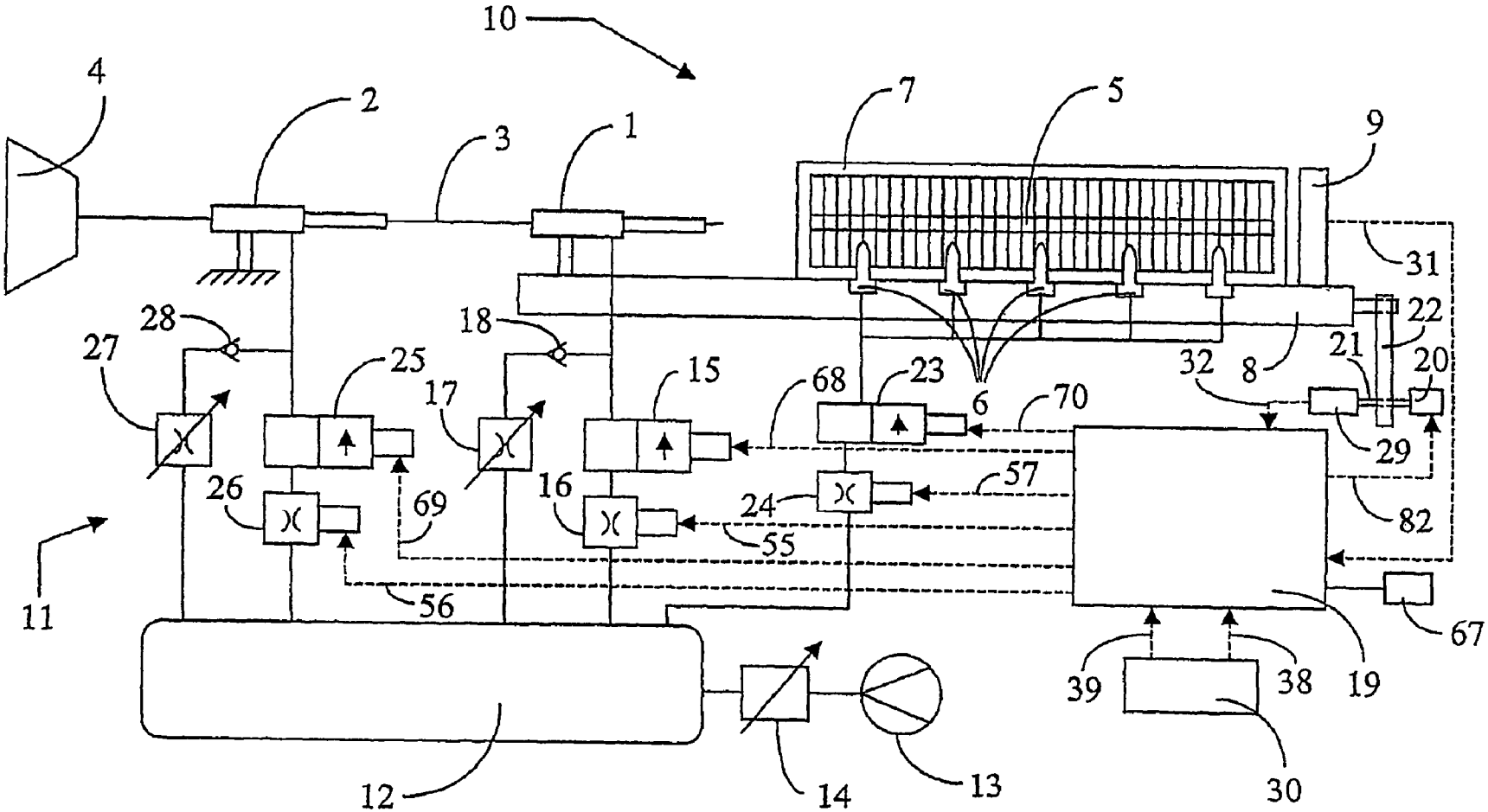
FIG. 1 diagrammatically depicts part of an air weaving machine according to the invention.

FIG. 1 shows a device 10 for introducing a weft thread in an air weaving machine. This device comprises two main blowers 1 and 2 which can interact with a weft thread 3. The weft thread 3 originates from a thread stock 4. The weft thread 3 is blown into a guide passage 5 by the main blowers 2, 3 and is then blown further along the guide passage 5 by jets of air from the auxiliary blowers 6. The guide passage 5 is, for example, arranged in a reed 7 and during the introduction of a weft thread 3 is disposed in a known way in a shed. The main blower 1, the auxiliary blowers 6 and the read 7 are mounted in a known way on a sley 8. The main blower 2 and the thread stock 4 are mounted on the frame of the air weaving machine. A thread monitor 9, which can determine when a weft thread 3 passes said thread monitor 9, is arranged at the opposite end of the guide passage 5 from the main blower 1.

The air weaving machine also comprises a feed device 11 for feeding compressed air to the main blowers 1, 2 and the auxiliary blowers 6. The feed device 11 comprises a buffer vessel 12. This buffer vessel 12 is connected to a compressed-air feed 13 and a pressure regulator 14. The pressure regulator 14 is, for example, manually adjustable. Between the buffer vessel 12 and the main blower 1 there is a first air feed for supplying compressed air at a high pressure, and a second air feed for supplying compressed air at a low pressure. The first air feed comprises a shut-off valve 15 and a motor-adjusted throttle valve 16. The second air feed comprises a manually adjustable throttle valve 17 and a nonreturn valve 18. Between the buffer vessel 12 and the main blower 2 there is likewise a first air feed for supplying compressed air at a high pressure, which comprises a shut-off valve 25 and a motor-controlled throttle valve 26, and a second air feed for supplying compressed air at a low pressure, which comprises a manually adjustable throttle valve 27 and a nonreturn valve 28. Between the buffer vessel 12 and a set of auxiliary blowers 6 there is an air feed for supplying compressed air at a high pressure, which comprises a shut-off valve 23 and a motor-controlled throttle 24. Notwithstanding the fact that the example illustrated shows only one set of auxiliary blowers 6, it is also possible for an air weaving machine to comprise a plurality of such sets of auxiliary blowers, each provided with an associated air feed for supplying compressed air at a high pressure, in which case each air feed may comprise a shut-off valve and a throttle valve. As shown in FIG. 1, the feed device 11 also comprises connection lines for the compressed air. According to a variant which is not illustrated, it is possible to provide a separate buffer vessel for both the main blowers and the auxiliary blowers.

The shut-off valves 15, 23 and 25 and the throttle valves 16, 24 and 26, as illustrated in FIG. 1, are controlled by a control unit 19 of the air weaving machine. The throttle valves 16, 24 and 26 comprise, for example, a controllable stepper motor which can be controlled in both directions with a desired number of steps and for a desired time interval by means of the control unit 19. The shut-off valves 15, 23 and 25 comprise, for example, electromagnetic valves which can be controlled by the control unit 19.

If the shut-off valves 15, 23 and 25 are opened at suitable moments during a weaving cycle by being actuated via the control unit 19, compressed air is fed from the buffer vessel 12 via the throttle valves 16, 24 and 26 and the shut-off valves 15, 23 and 25 to the associated main blowers 1, 2 or auxiliary blowers 6, so that a weft thread 3 can be transported through the guide passage 5. If the shutoff valves 15 and 25 are closed, compressed air is fed via the throttle valves 17, 27 and the nonreturn valves 18, 28 to the associated main blower 1, 2. In this case, compressed air at a low pressure is supplied as a result of the setting of the throttle valves 17, 27.

The weaving machine illustrated in FIG. 1 also comprises a drive motor 20 which, via a main drive shaft 21 and a mechanism 22, drives the sley 8 in reciprocating fashion. As is customary, the main drive shaft 21 is rotated, for example, one complete revolution during each insertion, so that the angle position of the main drive shaft 21 is also the angle position of the weaving machine. In this case, the main drive shaft 21 also cooperates with an angle sensor 29 in order for the angle position of the weaving machine to be transmitted to the control unit 19. The figure also illustrates an input unit 30 for inputting data into the control unit 19. The control unit 19 comprises a regulating unit for adjusting at least the throttle valves 16, 26 and/or 24. The control unit 19 also comprises a regulating unit for adapting the number of insertions used to determine the mean deviation of an insertion parameter, as will be described in more detail below.

The device 10 according to the invention permits the quantity of compressed air supplied at a high pressure during weaving to be adjusted as a function of a deviation of an insertion parameter. In this case, by way of example, a throttle valve 16, 26 can be controlled in such a manner that, for example, the moment at which a weft thread 3 passes the thread monitor 9 (i.e., weft thread arrival) is virtually equal to the moment at which the main drive shaft 21 adopts a defined angle position. This permits the setting of a throttle valve 16, 26, 24 to be adapted to the properties of the woven weft threads, and more particularly permits the quantity of compressed air supplied to be adapted to the behaviour of the weft threads that have been introduced. This also means that the quantity of compressed air supplied to a weft thread can be automatically adapted as a function of measurements during the introduction of a weft thread, the measurements having taken place, for example, during the introduction of a number of previous weft threads.

In air weaving machines, it is customary to weave at a weaving speed of the order of magnitude of 800 to 1200 weft thread insertions per minute. In this case, an insertion of a weft thread takes up only a few milliseconds. When weaving irregular weft threads, for example spun weft threads, it is possible that for successive weft threads the deviation of the measured insertion parameter may differ considerably from weft thread to weft thread, with the result that if a control parameter for the insertion, for example the control or setting of throttle valves 16, 26, is changed as a function of a deviation of this type, a control parameter of this type will be changed a large number of times and that many changes will be superfluous or even erroneous.

To avoid this, according to a method for introducing a weft thread in a weaving machine, a control parameter of an insertion is adjusted as a function of a mean deviation of an insertion parameter which has been determined for a plurality of insertions. The formation of a mean of this type permits differences from insertion to insertion to be averaged out. According to the invention, the number of insertions for determining the mean deviation of an insertion parameter is adapted in order to manage the number of changes in a control parameter. In this context, the term manage is to be understood as meaning, inter alia, the possibility of reacting sufficiently quickly to a change in a measured insertion parameter, but not too quickly. This management allows superfluous or even erroneous changes to be avoided.

Examples for, inter alia, adjusting a control parameter are explained with reference to FIG. 2. The adapting of the number of insertions for determining a mean deviation is also explained with reference to FIG. 2. A signal 31 from a thread monitor 9 is compared with a signal 32 from an angle sensor 29 by means of a unit 33. The unit 33 generates a difference value 34 (i.e., deviation) which is fed to a unit 35. This difference value 34 is, for example, the time difference between a pulse from the detector 9 and a pulse from the angle sensor 29. The unit 35 determines a mean for the abovementioned difference values 34 which have been determined during a number of insertions and feeds a value 36 (mean deviation value) for this mean to a unit 37. With the aid of an input unit 30, which comprises for example a conventional keyboard, an initial value 38 for the abovementioned number of insertions is fed to the unit 35. A threshold value 39 is also fed to the unit 37 via the input unit 30. If the absolute value of the value 36 is lower than the threshold value 39, the counter 40 is increased by a number (for example 1) by the unit 37 via a signal 41. If the absolute value of the value 36 exceeds the threshold value 39, a control unit 42 is activated by the unit 37 via a setting signal 43. For weaving machines which weave at a speed of 1200 insertions per minute, a threshold value 39 is, for example, between 0.5 and 2 milliseconds, for example 1 millisecond.

The control unit 42 then adjusts the throttle valves 16, 26, 24 in a suitable way as a function of this setting signal 43. For this purpose, the control unit 42 generates control signals 55, 56 or 57 for suitably adjusting the throttle valves 16, 26, 24 in order, for example, to minimize the difference value 34. If the value 36 indicates that the weft threads are arriving too late or in this case for example is negative, the control signals 55, 56 or 57 will increase the quantity of compressed air supplied via the throttle valves 16, 26 or 24. If the value 36 indicates that the weft threads are arriving too early or in this case is for example positive, the control signals 55, 56 or 57 will reduce the quantity of compressed air supplied via the throttle valves 16, 26 or 24. The control unit 42 also sends a signal 58 to the counter 40 in order to read the value of the counter 40. Depending on whether the setting signal 43 has a positive value or a negative value, the control unit 42 respectively sends a signal 44 or a signal 45 to a unit 46, which stores a respective value for a signal 44 or 45 of this type in its memory.

If the counter 40 indicates a number of insertions between a minimum value of, for example, "125" and a maximum value of, for example, "1250" at the instant at which it receives a signal 58, the counter 40 is reset to zero. The input unit 30 can be used to input the value 59 for the abovementioned number of "125" insertions and to input the value 60 for the abovementioned number of "1250" insertions. The counter 40 also sends a signal 47 to the unit 46, which removes any value for a signal 44 or 45 which may be stored in a memory of the unit 46 from the memory of the unit 46. If the counter 40 indicates a number of insertions higher than "1250", the counter 40 sends a signal 48 to the unit 50, which in turn sends a signal 49 to the unit 35 in order to lower the value for the number of insertions by a numerical unit. If the counter 40 indicates a value lower than "125", the counter 40 sends a signal 51 to a unit 46. If the unit 46 has received both a signal 44 and a signal 45 and has then stored a value therefor, and if a signal 51 is then supplied, the unit 46 sends a signal 52 to the unit 50, in such a manner that the unit 50 sends a signal 53 to the unit 35 in order to increase the value of the number of insertions by a numerical unit. If the counter 40 indicates a number of insertions higher than "2000", the counter 40 is reset to zero, and, preferably, the system will react as if the threshold value was exceeded.

The abovementioned method offers the advantage that if the threshold value is not exceeded for a large number of insertions, the number of insertions for determining the mean or for determining the value 36 can be reduced. If the threshold value is exceeded after just a small number of insertions, the abovementioned method permits the abovementioned number to be increased, in such a manner that the threshold value is exceeded less quickly. If the setting signal 43 is positive or negative in quick succession and if the counter 40 in each case indicates fewer than "125" insertions, this means that the system is unstable and that the number of insertions needs to be increased. The overall result is a system in which the throttle valves 16, 26 or 24 are adjusted in a suitable way but are not adjusted too frequently or unnecessarily.

According to a variant, both a threshold value 39 for, for example, a positive value 36 and a threshold value 54 for, for example, a negative value 36 can be set. By way of example, the threshold value for a weft thread which has arrived too early can be set to be greater in relative terms than the threshold value for a weft thread which has arrived too late. It is also possible for the values 59 and 60 and the initial value 38 to be suitably changed or set. The number of insertions at which the counter 40 is reset to zero can also be input via the input unit 30.

According to a variant, the number of insertions for determining the mean value 36 can only be reduced if, for example, more than "1250" insertions are woven two or more times in succession without exceeding the threshold value 39 or 54. Similarly, the number of insertions for determining the mean value 36 can only be increased if the threshold value is positively and negatively exceeded a number of times in succession. In the example shown, the number of insertions is lowered as soon as the condition of more than "1250" insertions without exceeding the threshold value is satisfied, whereas in this example fewer than "125" insertions while remaining above the threshold value twice, a positive signal 44 and a negative signal 45 have to be obtained before the number is increased. The conditions for increasing the number are in this case stricter than those for reducing the number.

If a regular weft thread is being woven, the method will, for example, start with an initial value 38 of, for example, "32", and over the course of time this number will be reduced to "24". For a more irregular weft thread to be woven, this number will be increased, for example, to "96". As described above, this number is increased or reduced by numerical unit, i.e. by a value of "1". However, it is also possible to use only a few defined values for this number and to restrict this number to "4", "6", "8", "16", "32", "48", "96" or "128". If the method starts at "32" and the unit 50 receives a signal 48 to reduce the number, the unit 50 reduces the number to "16" in a single step. If the method starts at "32" and the unit 50 receives a signal 52 to increase the number, the unit 50 increases the number to "48" in a single step. The number is suitably increased or reduced to a different, following higher or lower value in a similar way.

The abovementioned method permits a control parameter for an insertion to be changed as a function of a mean deviation of an insertion parameter, more particularly allows a control signal 55, 56, 57 to be generated as control parameter in order, for example, to minimize a value 36. In this case, the number of insertions for determining the mean deviation of an insertion parameter is adapted as a function of the number of insertions between at least two changes to a control parameter for an insertion, more particularly as a function of the values for a counter 40.

According to one possible embodiment, the method also comprises adapting at least one threshold value for the mean deviation, more particularly the threshold value for a positive deviation or the threshold value for a negative deviation. According to one possible option, a threshold value of this type is adapted as a function of the number of insertions for determining the mean deviation of an insertion parameter. For this purpose, the unit 50 can generate a signal 61 to, for example, increase the positive threshold value and can generate a signal 62 to, for example, increase the negative threshold value.

An abovementioned threshold value may be related to the abovementioned number of insertions. If the number of insertions for determining the mean is low, this means that the weft thread is relatively regular and the threshold value can be reduced. If the number of insertions for determining the mean is high, this means that the weft thread is relatively irregular and the threshold value ought to be increased. According to a preferred embodiment, the threshold value is increased when the abovementioned number of insertions is increased, and the threshold value is reduced when the abovementioned number of insertions is reduced.

Figure 2:
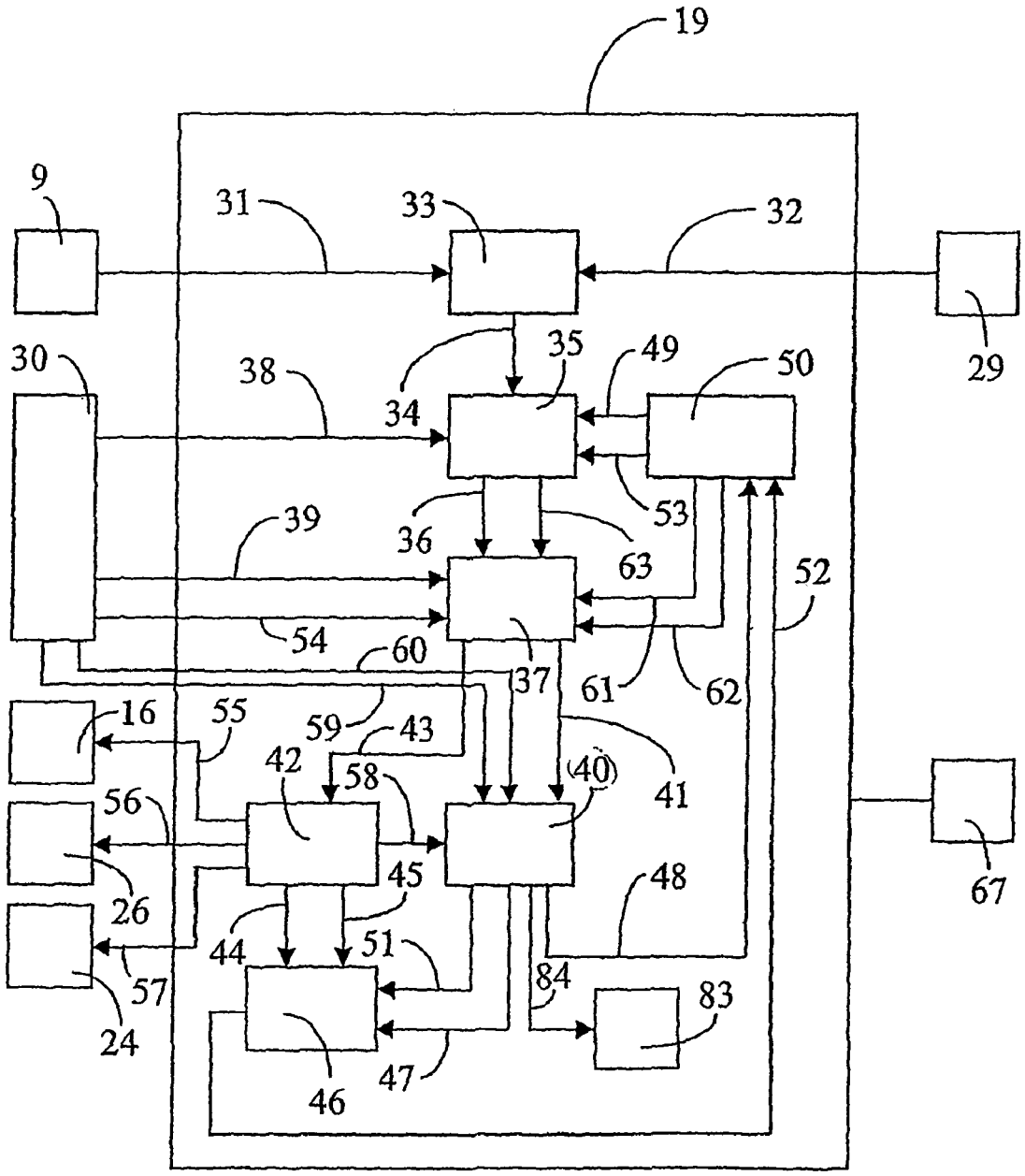
FIG. 2 shows a flowchart of a method according to the invention.

FIG. 2 also illustrates a variant in which the threshold value, i.e. the absolute threshold value, the positive threshold value and/or the negative threshold value, is determined during weaving. For this purpose, the statistical distribution range of the value 34 over a number of insertions is determined with the aid of the unit 35. This unit 35, in addition to a value 36 for the mean, also sends a value 63 for the statistical distribution range to the unit 37. The unit 37 then determines the threshold value, for example as double the abovementioned distribution range. If a regular weft thread is being woven, this distribution range will also be relatively narrow, so that the associated threshold value will also be relatively low. If a more irregular weft thread is being woven, this distribution range will also be relatively wide, so that the associated threshold value will also be relatively high. The invention offers the advantage that the threshold value and the number of insertions will be low for regular weft threads, so that it will be possible to react to a deviation very quickly. In the case of irregular threads, the threshold value and the number of insertions will be high, so that there will be less tendency to react to a deviation. This makes the invention particularly suitable for use for weaving any type of weft thread, and the sensitivity of the regulation or the stability of the regulation will be virtually unaffected by the regularity or irregularity of the weft threads. As a result, the method is suitable for weaving any type of weft thread whatsoever without errors.

It is also possible for combinations of the abovementioned methods to be used for determining the threshold value; by way of example, it is possible to make use both of a value 63 and of a signal 61, 62 to determine the threshold value or threshold values. For this purpose, a table, which indicates a suitable threshold value as a function of the value 63 and as a function of the value which is determined by the signals 61 or 62, can be stored in the unit 37.

It will be clear that the terms value and signal are given purely as examples. Any value can be replaced by, for example, a digital or analog signal, while each signal can be replaced by a value. The terms value and signal are generally digital signals or values which are present in a control unit 19 or microprocessor.

Figure 3:
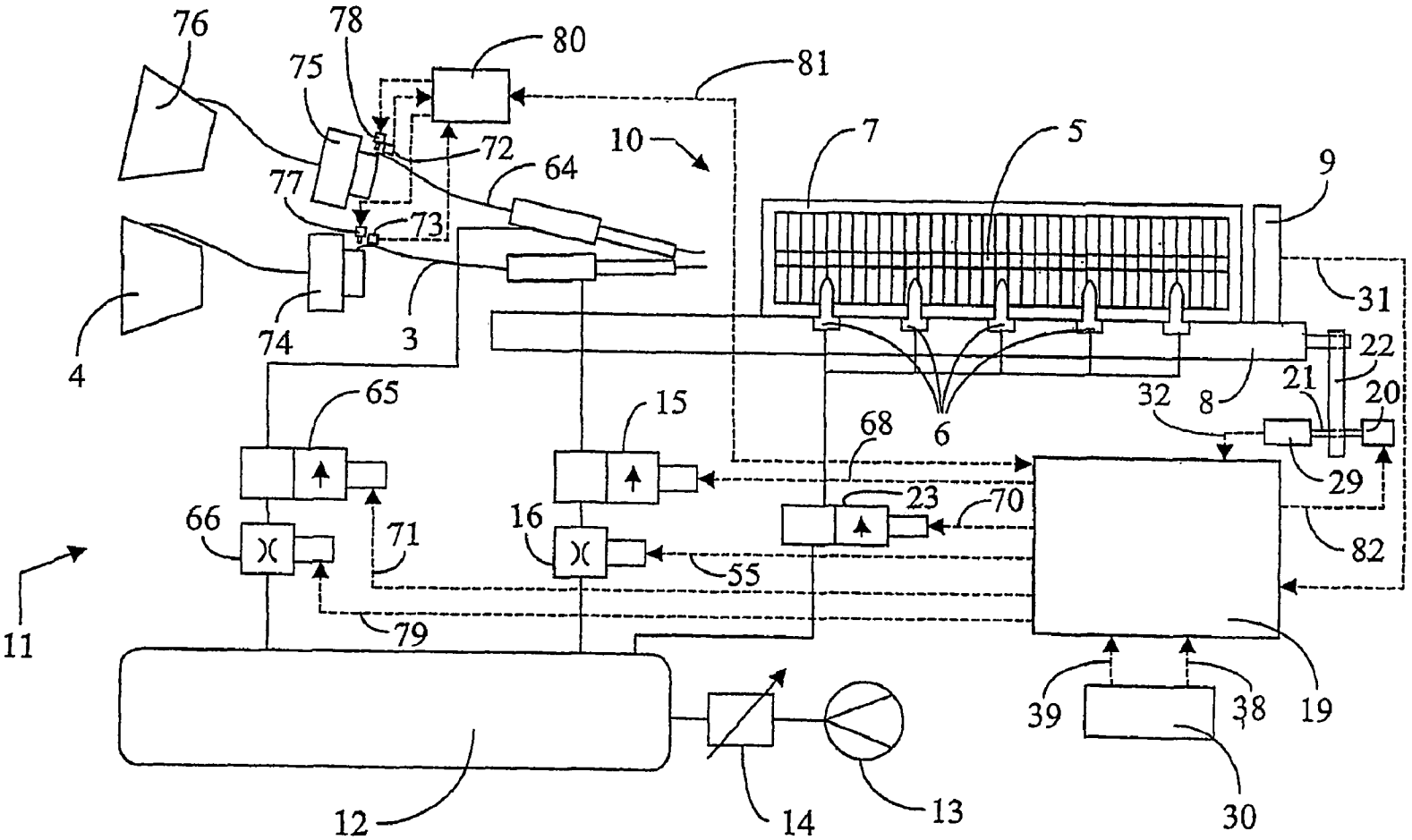
FIG. 3 shows a variant of FIG. 1.

FIG. 3 illustrates a variant in which two weft threads 3 and 64 are woven in succession in a pattern. In this case, by way of example, the motor-controlled throttle valve 16 will be adjusted as a function of measurements which have been performed during the introduction of the weft thread 3, and the motor-controlled throttle valve 66 will be adjusted as a function of measurements which have been performed during the introduction of the weft thread 64. A shut-off valve 65 is also provided for the weft thread 64. A suitable number of insertions for each of the weft threads 3 and 64 for determining the mean or for determining the distribution range will be set or adjusted, and at least one suitable threshold value will be set or adjusted. If more than two weft threads are being woven in a pattern, it is possible for an abovementioned number and/or abovementioned threshold values to be determined for each type of weft thread.

The method according to the invention also offers the advantage that there is no need to use a thread monitor 9 and/or an angle sensor 29 which are very sensitive. The method according to the invention can easily be used to average out errors in detection. It will be clear that a deviation or difference value 34 can also be determined in other ways. By way of example, the difference value 34 can be determined as the difference between the moment in the weaving cycle at which a thread monitor 9 detects a weft thread and a moment in the weaving cycle at which a signal from the thread monitor 9 is expected. It will also be clear that during regulation the difference value does not necessarily have to be approximately zero, but rather the difference value can also be compared with a specific desired value for this difference value.

It will be clear that as an alternative to a thread monitor 9 which is disposed at the end of the guide passage 5, it is also possible to use a thread monitor 72, 73 which, for example, can detect a winding being pulled off a yarn storage device 74, 75. In turn, each storage device 74, 75 pulls weft thread from a thread stock 4, 76. Combinations of a plurality of thread monitors are also possible, which offers the advantage that notwithstanding the fact that one thread monitor may detect an incorrect signal, it is still possible to generate a correct signal on the basis of the signals from a plurality of detectors, or that no signal is generated for a specific weft thread if the thread monitors detect contradictory information.

In addition to regulation according to the invention, it is also possible to provide what is known as fast regulation, which becomes active, for example, if the deviation deviates considerably from a normal deviation during one or a few insertions. In this case, an action can be undertaken without taking account of the mean deviation over the defined number of insertions, and a setting signal 43 can be generated immediately on the basis of a deviation of one or a few insertions. If it is established that this fast regulation is becoming active repeatedly or is becoming active unnecessarily, the system can switch off regulation of this type. This will, for example, take place automatically if the distribution range is of the order of magnitude of, for example, more than 2 milliseconds.

If specific types of weft thread are set, for example flax, it is possible, for example, for this fast regulation to be switched off automatically. To switch to fast regulation, it is also possible to investigate whether the difference value is actually correct, for example by investigating whether the detection of a weft thread at the thread monitor 9 is in line with other detections for the weft thread, for example with winding times which are determined or measured using a thread monitor 72, 73 when a specific winding is pulled off a storage device 74, 75.

According to one option, the statistical distribution range of the deviation, more particularly of the difference value 34, is determined over a number of insertions which is equal to the number of insertions for determining the mean deviation or difference value 34. According to a possible alternative, difference values over double the number of insertions compared to the number of insertions used for determining the mean deviation are used to determine the abovementioned distribution range. This offers the advantage that the distribution range determined as described above will be relatively constant.

In this context, the invention permits the determination of a range for forming a mean, more particularly the number of insertions for determining the mean. The result of this is that it is possible to react relatively quickly in the event of an unforeseen change in the behaviour of a weft thread during successive insertions and that the method also reacts relatively slowly to changing trends. If the system were to behave unstably in one way or another, it is possible for all the parameters to be initialized again. The particular feature of the invention is that if a low number of insertions is used to form a mean, the threshold value or threshold values will normally be low, and if a high abovementioned number of insertions is used to form the mean, the associated threshold value or threshold values will also be high.

The control unit 19 can also be connected to a display unit 67, on which all the values, difference values, initial values, threshold values, signals, setting signals, control signals and/or the value of the counter 40 can be presented. If one of the throttle valves 16, 26 or 24 is, for example, fully open, it is possible to provide a warning via the control unit 19 on the display unit 67 or via another system, such as a warning light.

Obviously, the feed devices 11 are not restricted to the feed devices illustrated, but rather may also be replaced by any form of feed device which can be used to set the supply of compressed air. By way of example, the throttle valves 17, 27 may also be of motor-controlled design. The latter option by way of example permits the low pressure when the weaving machine is not operating to be reduced, for example in order for a thread break to be repaired. When starting up the machine, the low pressure can be increased accordingly, since when the machine is starting up there is normally a higher risk of a weft thread dropping out of a main blower. According to one option, motor-controlled throttle valves 17, 27 of this type can, for example, also be controlled with a control parameter as a function of a mean deviation of an insertion parameter.

Notwithstanding the fact that in the example depicted the control signals 55, 56, 57 are used to adjust the throttling of a throttle valve, it is, of course, also possible for control signals of this type to be used to adjust another control parameter for an insertion, for example the pressure of the compressed air supplied, for example if a motor-controlled pressure regulator 14 is used, the control times of the shut-off valves 15, 25, 23 or 65, the control times of a magnetic pin 77, 78 which allows a weft thread 4, 64 to be released, an additional supply of compressed air to be switched on or still further control parameters of this nature for an insertion. The control parameters of the shut-off valves 15, 25, 23, 65 are respectively controlled by control signals 68, 69, 70 and 71, and the control parameters of the throttle valves 16, 26, 24 and 66 are respectively controlled via the control signals 55, 56, 57 and 79.

FIG. 3 also illustrates the fact that there is a control unit 80 which can receive signals from the thread monitors 72 and 73 and which can control the magnetic pins 77 and 78. The said control unit 80 can exchange signals, via a communication line 81, with the control unit 19, more particularly with the unit 33 or with the control unit 42 which form part of the control unit 19. These signals may, for example, comprise digital and/or analogue signals which are exchanged in series and/or in parallel.

The method according to the invention is particularly suitable for adjusting a control parameter for an insertion as has been extensively described above. The method is also suitable for adjusting a control parameter for the weaving speed of the weaving machine. In this case, the control unit 19, more particularly the control unit 42, can generate a control signal 82 for adjusting the angular velocity of the drive motor 20. If, for example, a weft thread on average arrives too late, the angular velocity of the drive motor 20 will, for example, be reduced in such a manner that the weft thread arrives at the desired moment. If, by way of example, the weft thread on average arrives too early, the angular velocity of the drive motor 20 will, for example, be increased, in such a manner that the weft thread arrives at the desired moment. The drive motor 20 can be controlled, for example, on the basis of the control signal 82 which determines whether the drive motor 20 needs to be driven more quickly or more slowly. The speed of the drive motor 20 can be controlled in a similar manner to that described in EP 1 032 867 B1 and as a function of the control signal 82.

When the method according to the invention is used, the result, for example, will be that the number of insertions, adapted according to the invention, i.e., adapted by determining and/or analyzing monitored or measured deviations of an insertion parameter of its desired value for which a mean deviation is determined, will be different for different bobbins, or that this number will change while a weft thread is being pulled off a bobbin.

It will be clear that the number of insertions for determining the mean does not always have to be adapted in accordance with the invention. According to a variant, this number can be set manually, the method according to the invention can be active for a certain time until a new value is obtained for the number, and then this value can be retained, i.e. the method according to the invention is then switched off again. The initial value 38 may, for example, be set manually to between 4 and 500 insertions. The input unit 30 may also comprise a key or element for resetting to the initial value or threshold value. This is advantageous if it appears, after a certain time, that the system is no longer operating correctly, in order to ensure that all the adapted values are restored to their original value. This is known as a reset function.

The control unit 19 may also comprise a check unit 83 which can receive and store values 84 from the counter 40 which are representative of the number of insertions between two changes to a control parameter. The check unit 83 may in this case, for example, determine a mean number of insertions between two changes to a control parameter and can transmit this information to the display unit 67 in order for this number to be displayed. This makes it possible, for example, to investigate whether the mean number of insertions is between "125" and "1250" insertions, more particularly is in the vicinity of "125" or in the vicinity of "1250".

If, as shown in FIG. 3, two or more different types of weft threads 3 and 64 are being woven, it would be clear that a respective number of insertions for determining a mean deviation can be determined for each of these weft threads. In this case, an associated control unit 19 can be provided for each type of weft thread, or one single control unit can be provided, performing the function of the above-mentioned control units 19 for each weft thread.

It would be clear that the weaving machine is not restricted to an air weaving machine in which a weft, thread is blown into a guide passage 5 using compressed air. As an alternative to compressed air, it is also possible to use any other desired fluid for introducing a weft thread into a shed of a weaving machine. In this case, it is also possible to use standard compressed air which is mixed with another gas or with a liquid or steam.

The method and the weaving machine according to the invention presented in the claims are not restricted to the exemplary embodiments which have been illustrated and described, but rather may also encompass variants and combinations thereof which are within the scope of the claims.

The invention claimed is:

1. Method for controlling insertion parameters of weft threads in a weaving machine that includes a device for inserting weft threads and a control that adjusts weft thread insertion control parameters, comprising:

during weaving, measuring arrivals of a plurality of inserted weft threads and determining on the basis of such measured arrivals the deviations between actual arrivals and desired arrivals of the inserted weft threads;

determining on the basis of a selected number of determined deviations a mean deviation value of the weft thread insertions;

adjusting a weft thread insertion control parameter via the control as a function of said mean deviation value; and adjusting the number of determined deviations used to determine said mean deviation value as a function of variations of determined deviations.

2. Method according to claim 1, wherein the number of weft thread insertions used to determine said mean deviation value is varied as a function of the number of weft thread insertions that occur between at least two adjustments to said weft thread insertion control parameter.

3. Method according to claim 1, including the step of establishing a threshold value for the mean deviation value which is usable to adjust the number of weft thread insertions on the basis of which said mean deviation value is determined.

4. Method according to claim 3, including varying the threshold value as a function of the number of weft thread insertions used to determine a mean deviation value.

5. Method according to claim 4, wherein the threshold value is increased if said number of weft thread insertions used to determine the mean deviation value increases, and the threshold value is reduced if the number of weft thread insertions used to determine the mean deviation value decreases.

6. Method according to claim 1, including initially setting an initial number of weft thread insertions to be used to determine the mean deviation value.

7. Method according to claim 6, including resetting the initial number of weft thread insertions used to determine the mean deviation value if a desired mean deviation value is not achieved with the initial number of weft thread insertions.

8. Weaving machine, comprising apparatus for carrying out the method as recited in claim 1.

9. Weaving machine according to claim 8, wherein the weaving machine weft thread insertion control is configured to enable adjustment of the number of weft thread insertions used to determine the mean deviation value.

* * * * *